US005368265A

United States Patent [19]

Gueli

[11] Patent Number: 5,368,265

[45] Date of Patent: Nov. 29, 1994

[54] FUSIBLE SUPPORT FOR SIGNS

[75] Inventor: Carmen Gueli, Saginaw, Mich.

[73] Assignee: Globe Technologies Corporation, Standish, Mich.

[21] Appl. No.: 828,733

[22] Filed: Jan. 31, 1992

[51] Int. Cl.[5] ..... A47B 96/06

[52] U.S. Cl. ..... 248/214; 169/42; 248/317

[58] Field of Search ..... 248/214, 317, 228, 342, 248/343; 169/42, 37; 52/484, 39

[56] References Cited

U.S. PATENT DOCUMENTS

| | | | |
|---|---|---|---|
| 357,148 | 2/1887 | Hall . | |
| 1,221,497 | 4/1917 | Yates . | |
| 1,267,906 | 5/1918 | Rowley . | |
| 2,389,331 | 11/1945 | Tyden . | |
| 2,666,488 | 1/1954 | Ruegsegger . | |
| 3,727,695 | 4/1973 | Danton . | |
| 3,952,985 | 4/1976 | Davenport | 248/317 |
| 3,968,841 | 7/1976 | Harmathy . | |
| 3,998,273 | 12/1976 | Juliano . | |
| 4,118,000 | 10/1978 | Campbell | 248/228 |
| 4,135,692 | 1/1979 | Ferguson | 248/228 X |
| 4,191,352 | 3/1980 | Schuplin | 52/484 X |
| 4,223,488 | 9/1980 | Schoenung | 248/228 X |
| 4,315,611 | 2/1982 | Hoop | 248/317 X |
| 5,120,152 | 6/1992 | Gueli | 169/42 X |

FOREIGN PATENT DOCUMENTS

| | | | |
|---|---|---|---|
| 803862 | 11/1958 | United Kingdom | 169/42 |
| 903799 | 8/1962 | United Kingdom | 169/42 |
| 2244213A | 11/1991 | United Kingdom . | |

*Primary Examiner*—J. Franklin Foss

*Attorney, Agent, or Firm*—Learman & McCulloch

[57] ABSTRACT

A fusible sign support has a hanger adapted for connection to an overhead support and a bracket adapted for connection to a sign. The hanger and the bracket are secured to one another by a fusible, eutectic bonding material which liquefies at a selected, elevated temperature. When the bonding material liquefies the hanger and bracket separate enabling the sign to fall. The construction makes possible removal of a sign from the path of water emitted from a fire sprinkler head. The liquefication of the bonding material occurs at a temperature lower than that at which the sprinkler head is activated.

20 Claims, 3 Drawing Sheets

FUSIBLE SUPPORT FOR SIGNS

FIELD OF THE INVENTION

This invention relates to fusible apparatus operable to suspend an object, such as a sign, from an overhead support and more particularly to a sign support which releases the sign in response to an increase in ambient temperature to a predetermined level so as to ensure that the sign will be removed from the path of water emitted from a fire sprinkler head and prior to the actuation of such sprinkler head.

BACKGROUND OF THE INVENTION

In many buildings, such as department stores, signs are suspended from the ceiling to indicate zones within the building or other useful information. Signs preferably are suspended in an elevated position so as to make it possible for them to be visible notwithstanding the presence of shelving and the like supported on the floor of the building.

Prior art sign supports conventionally include a fastener of some type for suspending the sign from the ceiling at an elevated level. One form of ceiling fastener comprises a wire clip which can be coupled to supports for panels which form a drop ceiling. The fastener also is connected to the sign. In this construction the wire clip has an eyelet through which a screw may pass into the body of the sign so as to secure the clip to the sign.

Fire protection sprinkler heads also are supported in buildings in an elevated position. In some instances a sign is so close to one or more sprinkler heads that water emitted therefrom can impinge on the sign, thereby interfering with the desired flow of such water.

Although the wire clip sign support referred to above is inexpensive, sturdy, and easy to install, it does not provide for the automatic separation of a sign from its support when it becomes necessary to make use of the fire protection sprinkler system. Consequently, a sign supported by prior art devices may obstruct or interfere with the flow of water from one or more sprinkler heads when the latter are activated to quench a fire.

A sign support according to the invention overcomes the objectionable characteristics of known sign supports by automatically releasing the sign in response to an increase in ambient temperature to a selected level somewhat lower than that at which the sprinkler system is activated, thereby enabling the sign to fall clear of the path of water emitted from the sprinkler heads.

SUMMARY OF THE INVENTION

A sign support constructed in accordance with the invention comprises a hanger adapted to be secured to the ceiling of a building and a bracket for coupling the sign to the hanger. The hanger and the bracket are bonded together by a fusible material having eutectic properties and which is solid at temperatures below a predetermined, elevated temperature, but which liquefies at such elevated temperature, thereby enabling the hanger and the bracket to separate and permit the sign and the attached bracket to fall. Thus, neither the bracket nor the sign will interfere with the flow of water from a sprinkler head.

Preferably, the temperature at which the hanger and the bracket separate is lower than the temperature at which the sprinkler heads are activated. This ensures that the material bonding the hanger and the bracket will liquefy and effect clearance of the sign from the water spray path prior to the commencement of the spraying of water from the sprinkler heads, thereby avoiding the possibility of cooling the bonding material by the water and ensuring liquefication of the bonding material.

Ceiling supported signs of the type with which the support is adapted for use conventionally are fabricated from a rigid, cellular foam material having excellent insulating properties. The support according to the invention is so constructed as to preclude the eutectic bonding material from being thermally insulated by the sign.

THE DRAWINGS

DETAILED DESCRIPTION

Figure 1:
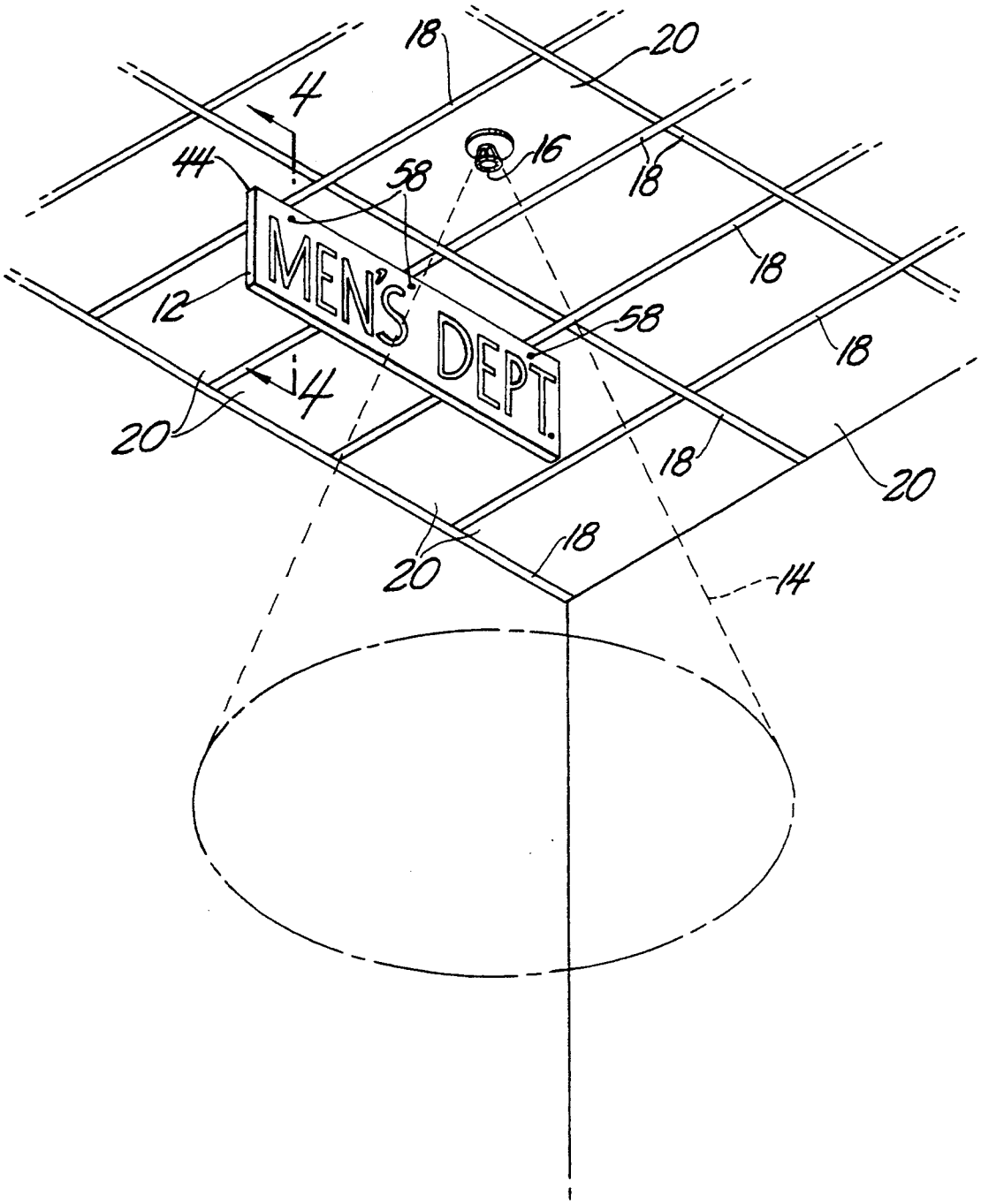
FIG. 1 is a fragmentary, isometric view of a typical drop ceiling construction from which a sign is suspended sufficiently close to a fire sprinkler head as to enable such sign to obstruct part of the flow of water from the sprinkler head.

A fusible support assembly constructed according to the invention is designated generally by the reference character 10. The assembly 10 is of the type adapted to suspend an object 12, such as a sign, from an elevated support such as a ceiling. For example, such a sign may indicate the location within a store, such as that shown in FIG. 1 as "Men's Dep't."

Many buildings utilize what is known as a drop ceiling wherein supporting track-like parts are suspended at a desired level above the floor and support tiles or panels which form the ceiling. Such a ceiling construction is shown in FIG. 1 wherein T-track members 18 are arranged in grid form to provide support for insulated panel members 20.

Many public buildings include a fire sprinkler system wherein a central pressurized water supply is piped to various strategically located sprinkler heads 16 which extend through selected ceiling panels. Each sprinkler head 16 is provided with a temperature sensitive control strut (not shown) which effects opening of a valve at a predetermined ambient temperature, typically on the order of 155° F. to 165° F., to effect spraying of a volume of water in a predetermined pattern 16 so as to wet a predetermined area. The sprinkler heads 16 are spaced from one another in such manner that the water emitted from the sprinkler heads is evenly distributed over the entire floor area of the building.

If an obstruction, such as the sign 12, is in the path of water sprayed from a sprinkler head 16, the water emerging from such sprinkler head will be diverted or deflected from the path it was designed to take, thereby diminishing the effectiveness of the fire sprinkler system.

The sprinkler head 16 may be any one of a number of conventional constructions, such as that shown in Glinecke U.S. Pat. No. 4,343,364 or Gueli U.S. Pat. No. 4,796,420, the disclosure of each of which is incorporated herein by reference.

The sign support assembly 10 includes an L-shaped hanger 22 for securing the assembly 10 to a track 18 of the ceiling. The hanger 22 is formed of suitable material, such as commercial brass, and has at one end a depending leg or tongue 24 having a semicircular free edge. A small hole 26 is formed in the tongue 24.

Extending from the tongue 24 is an elongate leg 28 which underlies a track 18 and has a pair of clasps 30, 32 for gripping opposite sides of a horizontal flange 33 forming a part of the track 18. Each of the clasps has a body which overlies and is spaced from the leg 28 by a distance corresponding generally to the thickness of the track flange. Each clasp body has one corner 34, 36 bent upwardly to facilitate attachment of the hanger to the track flange. The clasps 30, 32 are positioned at opposite edges of the hanger leg 28 from one another, with the clasp 30 adjacent the tongue 24 and the clasp 32 remote from the tongue. The clasps may be bent in such manner that they require some displacement during attachment to the track flange so that the hanger leg is frictionally retained on the flange.

Figure 2:
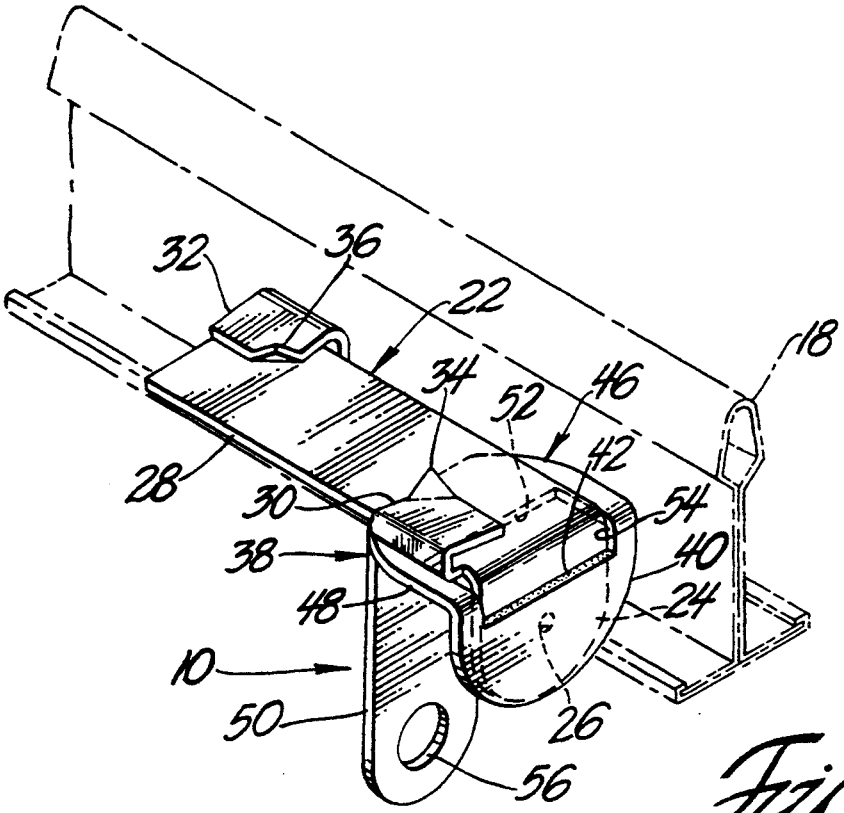
FIG. 2 is a fragmentary, enlarged, isometric view of the sign support attached to a typical part of a ceiling member.
Figure 3:
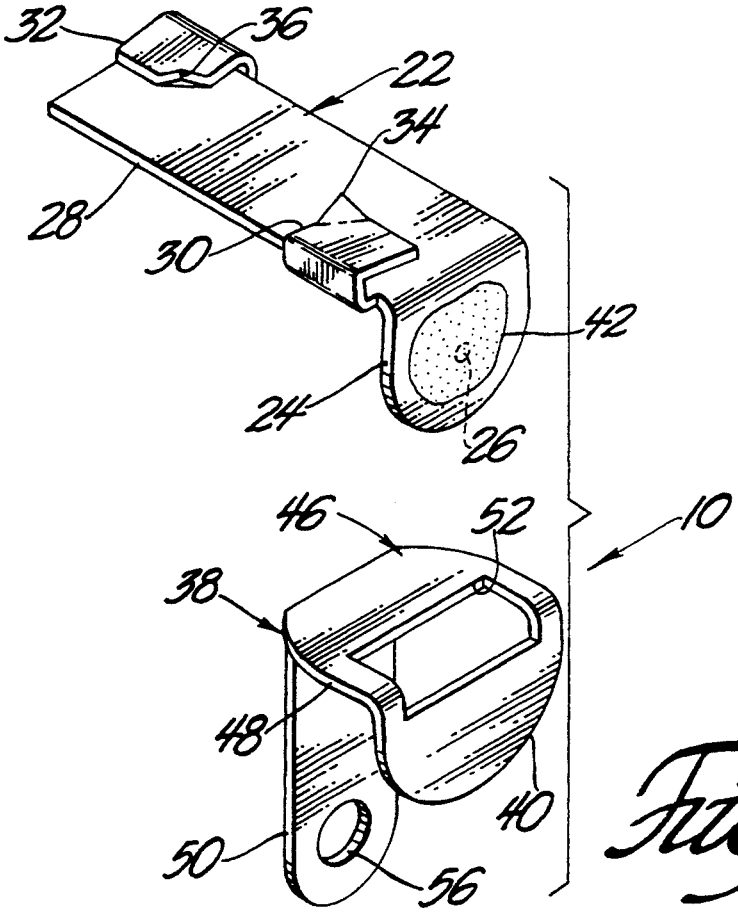
FIG. 3 is an exploded view of the sign support.

As is shown in FIG. 2, the hanger 22 is attached to the track flange by positioning the latter between the two clasps 30, 32 with the leg 28 underlying and confronting the bottom of the flange. Prior to its assembly with the track, the hanger is skewed relative to the track 18 so that the hanger must be rotated into place with the corners 34, 36 of the respective clasps 30, 32 riding up and over opposite edges of the track flange. When rotated into the position shown in FIG. 2, the clasps 30, 32 securely retain the hanger 22 on the track 18. In this position, the tongue 24 depends perpendicularly from the track 18.

A sign attaching bracket, generally designated 38, is provided for attaching the sign 12 to the hanger 22. The bracket also may be formed of commercial brass and comprises a U- or J-shaped body having a shorter leg 40 and longer legs 50 parallel to and spaced from the leg 40 by a web 48. The length of the leg 40 corresponds substantially to that of the tongue 24 of the hanger 22, but the length of the web 48 is substantially less than that of the leg 28. An opening 52 is formed in the bracket 38 and extends partially into both the leg 40 and the web 48. The width of the web is sufficiently great to enable the side-to-side width of the opening 52 to accommodate the tongue 24 freely, whereas the length of that portion of the opening 52 in the web 48 is considerably greater than the thickness of the tongue 24. The members 22 and 38, therefore, easily may be assembled by passing the tongue 24 through the opening 52 so that the tongue and the shorter leg 40 confront one another and the leg 28 confronts the web 48. The extension of the opening 52 into the leg 40 ensures close proximity of the tongue 24 and the leg 40.

A thermally sensitive, fusible, bonding material 42 is interposed between the confronting surfaces of the tongue 24 and the leg 40 and secures the tongue and the leg together. Preferably, the area of the material 42 corresponds to that of the tongue 24. The bonding material has eutectic properties. That is, the material is solid until it is heated to a predetermined, elevated temperature at which it liquefies. A suitable eutectic bonding material is composed of an alloy of lead, bismuth, and indium. The proportions of these metals can be adjusted to provide a selected melting point, such as 135° F., at which the material 42 liquefies, whereupon the bond between the members 22 and 38 is dissolved and they may separate.

If the fire sprinkler heads 16 are selected to be activated at an ambient temperature of between 155° F. and 165° F., the constituency of the bonding material 42 should be so selected that it will liquefy at a lower temperature, such as between 120° F. and 142° F.

The thickness of the bonding material 42 may vary, but a thickness of approximately 0.006 inch has been found to be satisfactory. Conventional, low temperature soldering techniques may be used to bond the members 22 and 38 to one another via the material 42. Preferably, the opening 26 is filled with the material 42, thereby providing an interlock between the latter and the tongue 24.

The longer leg 50 of the bracket member 38 has a smoothly rounded free end adjacent which is formed an opening 56. The level of the opening 56 preferably is below that of the free end of the leg 40.

The apparatus thus far described is adapted to attach the sign 12 to the ceiling track 18 in such manner that the sign is suspended from the ceiling in an elevated, easily seen position. The sign may be formed in any one of a number of conventional ways, but as shown it comprises a body 44 formed of thermally insulating material. The body has a slot 60 in its upper edge of such depth and width as to accommodate the longer leg 50 of the bracket body 38. The sign body is adapted to accommodate a securing screw 38 which extends through the opening 56 in the leg 50 so as to secure the sign to the bracket 38. The sign may be secured to the bracket of two or more of the assemblies 10 so as to provide adequate, horizontal support for the sign.

Figure 4:
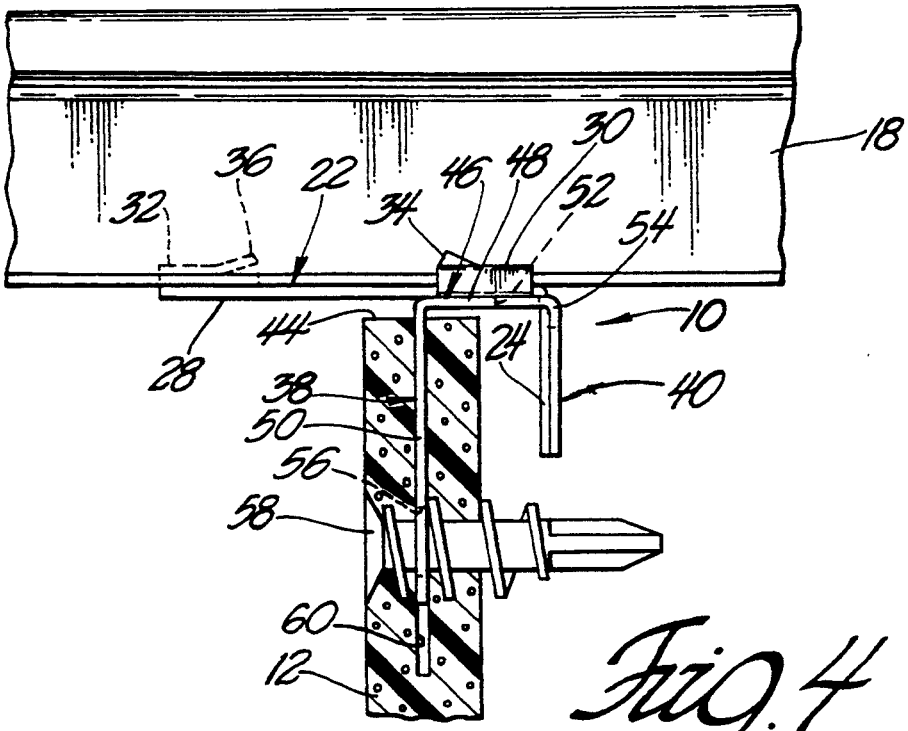
FIG. 4 is an enlarged, cross sectional view taken along the lines 4—4 of FIG. 1.

As is best shown in FIG. 4, the bracket 38 is secured to the sign body 44 in such manner that a gap 62 exists between the tongue 24 and the adjacent face of the sign body. The gap enables air to flow between the sign body and the tongue 24, thereby avoiding insulating the tongue 24 and ensuring adequate exposure of the bonding material 42 to ambient temperature.

To install a sign 12, two or more hangers 22 are assembled with and fused to a corresponding number of brackets 38. The assembled units then are secured to the tracks 18 at suitably spaced intervals. Thereafter, the leg 50 of each bracket member 38 is fitted into the slot 60 of the sign body and secured therein by the screw 58. The sign thus is suspended from the ceiling in a visible position.

Because of the gap between the sign body 44 and the tongue 24 the suspended sign is laterally offset from the interface of the tongue 24, the leg 40, and the bonding material 42. This relationship creates a bending moment between the fused members 24 and 40, thus stressing the bonding material 42 in tension, whereas the weight of the sign stresses the bonding material in shear. The tensile stress created by the bending moment is greater at the free end of the leg 44 than at the opposite end thereof. The bonding material has greater resistance to tensile force than to shearing force, and has a tendency to creep over a period of time. The tendency of the bonding material to creep largely is overcome by the filling of the opening 26 with the bonding material to provide the aforementioned interlock. The greatest force tending to separate the hanger and bracket thus is the tensile force. As a consequence, the attachment of the members 22 and 38, although separable, is quite secure as long as the temperature of the bonding material 42 is less than the preselected temperature.

Figure 5:
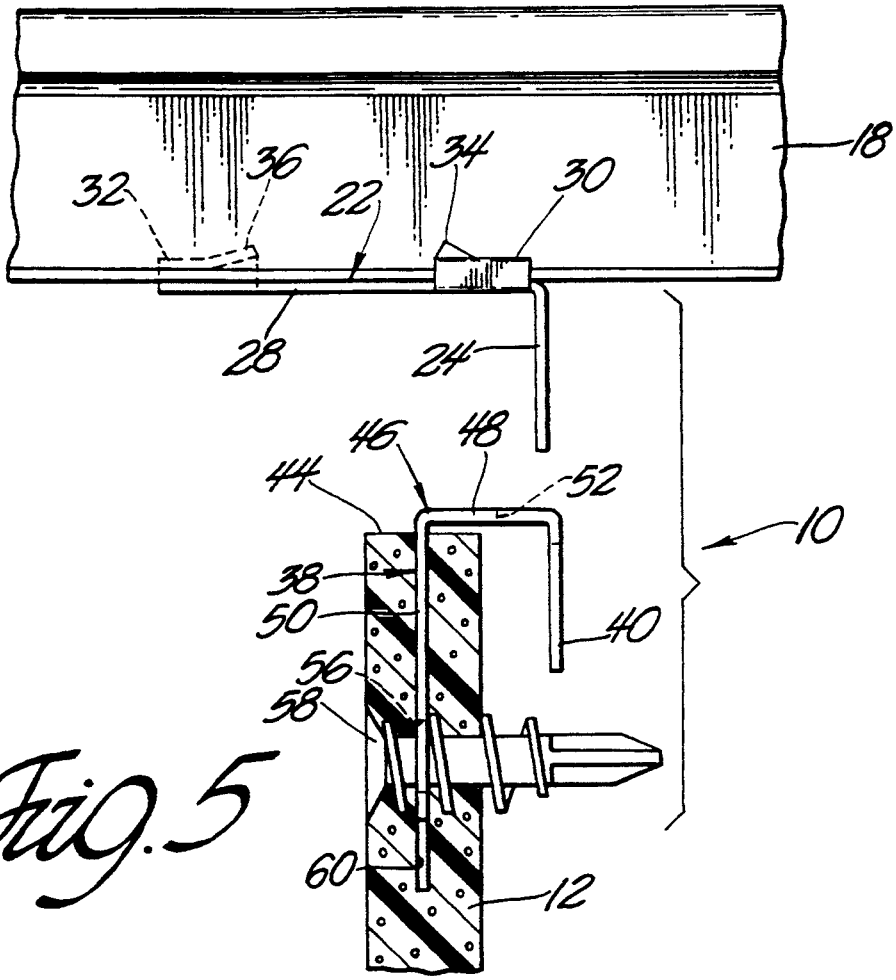
FIG. 5 is a view similar to FIG. 4, but showing the sign disengaged from the ceiling and falling.

When the ambient temperature rises to the liquefication temperature of the bonding material 42, such material will liquefy, thereby enabling the tongue 24 and the leg 40 to separate from one another and permit the sign 12 and the attached bracket member 38 to fall as is indicated in FIG. 5. If the temperature thereafter rises to the level sufficient to activate the sprinkler heads 16, water may flow therefrom and be unimpeded by the sign or its brackets 38.

A significant advantage in using a bonding material 42 having a lower liquefication temperature than the temperature at which the sprinkler heads are activated is that the bond between the hanger 22 and the bracket 38 will be dissolved prior to the emission of water from one or more adjacent sprinkler heads. This ensures that the bonding material will not be cooled by the water emitted from the sprinkler heads and forestalls any possibility that such cooling will preclude separation of the sign from its support.

The disclosed embodiment is representative of the preferred form of the invention, but is intended to be illustrative rather than definitive. The invention is defined in the claims.

I claim:

1. Apparatus for releasably suspending an object from an overhead support, said apparatus comprising hanger means; means for mounting said hanger means on said support; bracket means; thermally sensitive bonding means securing said bracket means to said hanger means, said bonding means being solid at temperatures below a predetermined temperature level and liquid at said predetermined temperature level; and means for coupling said bracket means to said object, said bracket means being separable from said hanger means in response to liquefication of said bonding means, thereby enabling said bracket means and any object coupled thereto to fall, said bracket means comprising a substantially U-shaped member having a pair of substantially parallel legs joined at corresponding ends by a web.

2. Apparatus according to claim 1 wherein said hanger means comprises an L-shaped member having a pair of substantially right-angular legs.

3. Apparatus according to claim 1 wherein said web has an opening therein which extends into one of said legs.

4. Apparatus according to claim 3 wherein the other leg of said U-shaped member has an opening therein for the accommodation of said coupling means.

5. Apparatus according to claim 1 wherein said hanger means includes an elongate leg and wherein the means for mounting said hanger means on said support includes at least one clip having a body overlying and spaced from said leg a distance sufficient to accommodate said support between said body and said leg.

6. Apparatus according to claim 5 wherein said body has one corner upturned to facilitate the accommodation of said support between said leg and said body.

7. Apparatus according to claim 1 wherein said bonding means comprises a material having eutectic properties.

8. Apparatus according to claim 1 wherein each of said hanger means and said bracket means has a leg, said legs confronting one another, and said bonding means being interposed between and bonded to said legs.

9. Apparatus according to claim 8 wherein one of said legs has an opening therein into which said bonding material extends.

10. Apparatus for releasably suspending an object from an overhead support on which at least one sprinkler head is mounted, said sprinkler head being responsive to an increase in ambient temperature to a predetermined level to emit a spray of fire extinguishing fluid, said apparatus comprising hanger means; means mounting said hanger means on said support; bracket means; means coupling said bracket means to said object; and thermally sensitive bonding means securing said bracket means to said hanger means, said bonding means being solid at temperatures below a selected temperature and liquid at said selected temperature, said bracket means being separable from said hanger means in response to liquefication of said bonding means thereby enabling said bracket means and said object to fall, said selected temperature level being lower than said predetermined temperature level, whereby said bracket means may separate from said hanger means prior to the emission of said fluid from said sprinkler head.

11. Apparatus according to claim 10 wherein said hanger means includes a substantially vertical leg depending from said support and said bracket means includes a first leg substantially parallel to and confronting the leg of said hanger means, said bonding means being interposed between and adhered to each of said legs.

12. Apparatus according to claim 11 wherein said bracket means includes a second leg spaced from and substantially parallel to said first leg, and wherein said coupling means couples said object to said second leg, the spacing between said first and second legs being sufficient to enable the passage of air between said object and said first leg.

13. Apparatus according to claim 10 wherein said hanger means comprises an L-shaped body having a pair of substantially normal legs one of which substantially parallels said support, and wherein said mounting means comprises at least one clip on said one of said legs and connected to said support.

14. Apparatus according to claim 13 wherein said clip comprises a body overlying and spaced from said one of said legs and wherein the space between said body and said one of said legs is sufficient to enable said support to be frictionally accommodated in said space.

15. Apparatus according to claim 10 wherein said hanger means comprises an L-shaped body having a substantially horizontal leg secured to said support and a substantially vertical leg depending from one end of said horizontal leg, and wherein said bracket means comprises a substantially J-shaped body having substantially parallel legs joined at corresponding ends by a web, said web and one of the legs of said J-shaped body having an opening through which the vertical leg of said L-shaped body extends, said one of the legs of said L-shaped body and said one of the legs of said J-shaped body confronting one another and being secured to each other by said bonding means.

16. Apparatus according to claim 15 wherein said one of said legs of said J-shaped body has an opening therein filled with said bonding material.

17. Apparatus according to claim 15 wherein said vertical leg of said L-shaped body occupies a position between said object and said one of the legs of said J-shaped body.

18. Apparatus according to claim 17 wherein said object is spaced from said vertical leg of said L-shaped body to form a gap between said body and said vertical leg.

19. Apparatus for releasably suspending an object from an overhead support, said apparatus comprising a hanger having a body from which an angular tongue extends; means for mounting said hanger on said support so that said tongue is substantially vertical; a bracket having a pair of substantially parallel legs spaced by a web, said web having an opening therein through which said tongue extends to occupy a position between said legs and adjacent one of said legs; thermally sensitive bonding means securing said tongue and said one of said legs to one another; and means for coupling the other of said legs to said object, said bonding means being liquefiable in response to a predetermined increase in its temperature for enabling said tongue and said one leg to separate from one another and said object to fall.

20. The apparatus according to claim 19 wherein said tongue has an opening therein into which said bonding means extends to form an interlock between said tongue and said one leg.

* * * * *

UNITED STATES PATENT AND TRADEMARK OFFICE

CERTIFICATE OF CORRECTION

PATENT NO. : 5,368,265

DATED : November 29, 1994

INVENTOR(S) : Carmen Gueli

It is certified that error appears in the above-indentified patent and that said Letters Patent is hereby corrected as shown below:

Column 4, line 27, change "38" to -- 58 --; line 33 change "gap 62 exists" to -- gap exists --; line 55, change "44" to -- 40 --.

Signed and Sealed this

Seventh Day of March, 1995

*Attest:*

*Attesting Officer*

BRUCE LEHMAN

*Commissioner of Patents and Trademarks*